US006782828B2

(12) United States Patent
Widener

(10) Patent No.: US 6,782,828 B2
(45) Date of Patent: Aug. 31, 2004

(54) PLIANT FIREARM PROJECTILES

(76) Inventor: Charles D. Widener, 80975 Indio Blvd. C7, Indio, CA (US) 92201

( * ) Notice: Subject to any disclaimer, the term of this patent is extended or adjusted under 35 U.S.C. 154(b) by 0 days.

(21) Appl. No.: 10/297,122

(22) PCT Filed: Apr. 9, 2001

(86) PCT No.: PCT/US01/11484

§ 371 (c)(1),
(2), (4) Date: Nov. 14, 2002

(87) PCT Pub. No.: WO01/79782

PCT Pub. Date: Oct. 25, 2001

(65) Prior Publication Data

US 2003/0183114 A1 Oct. 2, 2003

(51) Int. Cl.[7] ..... F42B 12/34
(52) U.S. Cl. ..... 102/502; 102/444
(58) Field of Search ..... 102/446, 447, 102/439, 444, 448, 501, 502, 506, 507, 508, 509, 510, 514, 515, 516, 525, 526

(56) References Cited

U.S. PATENT DOCUMENTS 3,369,534 A * 2/1968 Crosman ..... 124/26
3,894,492 A * 7/1975 Barr et al. ..... 102/520
3,952,662 A * 4/1976 Greenlees ..... 102/400
3,983,817 A * 10/1976 Tucker ..... 102/513
4,587,905 A * 5/1986 Maki ..... 102/430
4,777,883 A * 10/1988 Chevich ..... 102/503
4,913,054 A * 4/1990 Petersen ..... 102/439
4,913,056 A * 4/1990 Matysik et al. ..... 102/439
5,086,703 A * 2/1992 Klein ..... 102/439
5,235,915 A * 8/1993 Stevens ..... 102/439
5,408,931 A * 4/1995 Tallman ..... 102/439
5,440,994 A * 8/1995 Alexander ..... 102/439
5,898,125 A * 4/1999 Mangolds et al. ..... 102/439

FOREIGN PATENT DOCUMENTS

JP 3-287000 * 12/1991
WO WO 95/31690 * 11/1995

* cited by examiner

*Primary Examiner*—Peter M. Poon
*Assistant Examiner*—David J Parsley
(74) *Attorney, Agent, or Firm*—Marvin H. Kleinberg; Marshall A. Lerner; Kleinberg & Lerner, LLP

(57) ABSTRACT

A highly pliant projectile intended to be deployed from a firearm is adapted to be elongated during transit through the firearm. The propellant gases act upon a piston element which is coupled to a force transfer member that is positioned in a cavity within the projectile body so that propulsion forces are applied to the forwardmost part of the projectile, causing it to elongate, thereby reducing its diameter so as not to interfere with the walls of the firearm.

31 Claims, 5 Drawing Sheets

PLIANT FIREARM PROJECTILES

This is a continuation-in-part of my provisional application for patent Serial No. 60/196,353, filed Apr. 12, 2000, the priority of which is claimed for this application.

BACKGROUND OF THE INVENTION

1. Field of the Invention

The present invention relates to special purpose projectiles and more specifically to novel apparatus and methods for sequential integration of propellant forces onto highly pliant projectiles thus facilitating their safe and efficient discharge from firearms and other launching platforms. By controlling frictional energy losses, the pliant projectiles are prevented from lodging or decelerating in the barrel of the weapon.

The highly specialized projectiles incorporating innovations described in the present invention is directed towards law enforcement and military users and satisfies a pervasive and growing requirement for effective less lethal rounds and for breaching rounds in a variety of tactical law enforcement, military missions and weapon systems.

2. Description of the Related Art

Recent times have seen a rapid increase in the level of interest throughout the law enforcement and military communities in what has been alternatively referred to as nonlethal, less than lethal and currently, less lethal devices. Simultaneously, better methods of gaining entry to secured doors, gates and windows and the like, by various types of breaching rounds are also being sought.

Due to this increased awareness and gradual growth in the actual requirement, a proliferation of less lethal and breaching rounds, particularly for shotguns (which for many security personnel are the weapons of choice) have been developed and offered into these specialty markets. Few if any, less lethal or breaching cartridges for handguns or rifles have been offered that meet current requirements.

Some early efforts in less lethal development involved single wooden batons and rubber balls approximating the size of the shotgun bore were and are still offered in various materials in durometer values mostly in the eighty to ninety Shore "A" range. This degree of "hardness" is three to four times that of the human target body. This hardness value was required to propel the projectile safely from the firearm. Small rubber pellets approximating the size of 00 buckshot, also in the higher durometer range of sixty to ninety Shore "A", were introduced as crowd control devices with seven to ten pellets per twelve gauge round.

Currently, there is wide interest and guarded usage of the "shot bag" or "bean bag" concept which utilizes conventional small lead shotgun pellets or other dense spherical media contained in a square flexible flat bag which is approximately 1.5 inches on a side and with a weight of approximately 650 grains. When inserted into a conventional shotgun shell casing and fired at 300 ft. per second, the projectile produces over 120 ft/lbs of kinetic energy at impact.

There exists, particularly in law enforcement, universal discontent with the shot bag or bean bag concept and a virtual rejection of the rubber buckshot, wooden baton and rubber ball projectiles. The limited cross-sectional area that rubber buckshot presents to the target body surface in combination with their high Durometer values requires minimum weight and low muzzle velocities to prevent or minimize surface penetration. This results in ineffectual target body impact and, if the intended target surface is covered with heavy clothing, the round is virtually useless.

The rubber balls and wooden batons, if they are provided with sufficient momentum to make them effective, concentrate so much energy unto a relatively small area, that is, the kinetic energy density levels are so high, that users are routinely instructed by manufacturers' product literature to fire onto a surface in front of the target and ricochet the projectiles onto the target body. This technique is highly unpredictable, affects accuracy in already tense situations and is contradictory at best.

Bean bags or shot bags as they are called, whose use has slowly expanded based almost solely on the lack of viable alternatives, have very serious and widely recognized shortcomings. In the highly specialized world of law enforcement, wherein predictable product performance can make the difference between life and death, the difficulties of the shot bag round will eventually contribute to its ultimate demise, particularly with the introduction of any viable alternatives.

In a shot bag, the bag containing the lead (or other metal) shot is stowed in a rolled configuration in the shell casing. Despite continued efforts at product improvement, upon exiting the firearm, deployment of the shot bag into a flat or quasi parabolic configuration from its original rolled stowed configuration is highly unpredictable and rarely occurs, at least not within the first ten to fifteen feet of travel. Often the bag will not unroll until after twenty to twenty five feet of travel.

If the shot bag strikes any human target while still in a rolled configuration, the results can, depending on the location of the strike, often be life threatening, if not lethal. Most altercations in which a less lethal round may be appropriately utilized occur at very short ranges. In fact, standard operation procedures often preclude the use of any munitions, lethal or less lethal, at any range over twenty five to thirty feet.

By definition, any perpetrator that is at least twenty five feet away is not deemed an immediate threat. Less lethal discharges ideally should occur at very close ranges from five to fifteen feet. The shot bag, in order to overcome these apparent contradictions, is offered in a variety of kinetic energy levels which can only exacerbate the confusion already existing at a crime scene.

Equally disconcerting is the inherent lack of accuracy provided by the shot bag round. Upon exiting the muzzle, the bag eventually deploys into what is ideally a kind of parabolic symmetrical "blob" which sometimes can proceed to the target with limited accuracy. More likely, the bag deploys into an asymmetrical shape or is propelled sideways and "kites" or "planes" significantly off the intended target line, often times completely missing the target. Additionally, the shot bag can burst from the significant internal hydrostatic pressures generated at the target impact and, because physical orientation of the bag cannot be controlled or predicted, severe laceration type injuries can occur.

Continued effort to improve the performance of the shot bag have produced some improvements in accuracy. By trailing a long kite-like tail behind the standard shot bag, or by containing the lead pellets in the front portion of a sock-like container and trailing the remaining fabric "tail" as a stabilizer, the performance of a basically flawed product has somewhat improved.

However, close range lethality of these products due to their considerable projectile weight cannot be overcome. In addition, potential users cite a valid concern over use in that rioters and others can collect the spent projectiles and, by using the tail as a sling, effectively "return fire", endangering the safety of those originally deploying the projectiles.

In the past, attempts to reconcile the requirements for single projectile, less lethal ammunition with specifications regarding limits on levels of kinetic energy and kinetic energy densities delivered to a target body surface from virtually point blank to maximum effective range, required a variety of different rounds, none of which provided adequate target stopping power within acceptable kinetic energy density limits.

In the past, this requirement defined a technical contradiction in that enough energy must be imparted into a pliant projectile by virtue of its mass and velocity (momentum) so that adequate kinetic energy is delivered onto the target body surface at the moment of impact. The upper limit of this kinetic energy on a human target has been defined as approximately sixty five foot pounds. It has further been determined that to minimize or effectively eliminate projectile penetration of the target body upon impact, the kinetic energy density levels should not exceed approximately fifty to sixty foot pounds per square inch, which would require a total projectile surface contact area of approximately 1.2 square inches.

The aforementioned contradiction exists in that, until now, pliant projectiles with sufficiently low Durometer levels to accomplish this amount of physical distortion upon impact, could not and had not been safely and efficiently discharged from firearms.

Paralleling the growing interest in recent past for less lethal ammunition, is a similar worldwide requirement throughout law enforcement and military users for high energy, frangible shot gun rounds for breaching secured entry door locks, bolts and hinges while minimizing collateral damage. In addition, such a projectile could satisfy the as yet unspecified requirement for deflating steel belted vehicle tires or penetrating engine compartments or radiators while minimizing or eliminating the collateral damage and risk to other vehicles. This would provide a means to terminate vehicle pursuits, a pressing new challenge currently escalating throughout the United States.

Early on, shot gun shells loaded with buckshot or lead slugs were successfully utilized for breaching. However excessive collateral damage to property and personnel resulted as the heavy, non-frangible lead projectiles often penetrated adjacent walls and structures. In addition, the use of lead in any projectiles is being discouraged and even prohibited by governmental agencies because of environmental concerns.

Recently, high density, semi-rigid projectiles comprising industrial wax with nontoxic metal powders such as zinc have been suggested. Combinations of tungsten powders and various rigid polymers such as nylon and polyesters have also been introduced with limited success. The reduced mechanical integrity of the wax projectiles severely limited their exit velocities. The tungsten-polymer matrix combinations showed some promise but costs appear to be prohibitive, especially if the technology were to be applied to large shotgun projectiles. The high velocities required for optimum frangibility, resulted in collateral damage dangers to the shooter and to others.

SUMMARY OF THE INVENTION

In accordance with the present invention, a system for discharging highly pliant projectiles from weapons such as firearms or other launching devices comprises a shell casing or firing chamber with a charge of powder that, upon ignition, deploys a piston that constrains the expanding gases. The piston has a central post that is adapted to fit into a force transfer member. A pliant projectile has an interior cylindrical void into which a transfer member is inserted.

After ignition of the powder charge, the piston transfers the force of the expanding gases to a more forward location on the projectile via the transfer member. A space is provided between the base of the projectile and the piston to permit the transfer member to sufficiently elongate the projectile, thus reducing its diameter to clear the weapon. The piston then contacts the rear surface of the projectile, overcoming the remaining inertia in that section and the projectile, transfer member and piston are all accelerated from the cartridge or the firing chamber at the same rate and subsequently exit the barrel or the launch tube of the weapon.

In the less lethal round, the highly pliant projectiles have a Shore "A" Durometer value of approximately 20 to 40, which is comparable value for a human target body. In selective applications where non-lethality is not a concern, the innovations of the present invention can be used to propel projectiles having higher Durometer Shore "A" values ranging from 50 to 90 at muzzle velocities greater than 1500 feet per second and for substantially longer ranges.

The projectile may be filled with a powder or small particles of a dense material such as metal or other heavy material for increased mass without compromising pliancy. To improve accuracy and consistency, a stabilizing collar is incorporated on the rear of the projectile. The lightweight but rigid transfer member remains with the pliant projectile during flight to provide additional rigidity and stability and, upon impact with the target body, provides a stable axis on which the highly pliant projectiles collapse symmetrically onto the target body, often increasing to twice their original diameter.

In an extended range device, the piston may be an integral part of the transfer member or comprise individual components which are press fitted together to form a piston/transfer member assembly. The extended range version may or may not utilize a separate stabilizing collar. In the absence of a separate stabilizing collar, the piston is designed to act as a stabilizing device during flight.

The concept of having the inside diameter of the void in the projectile sufficiently large to permit the transfer member to slide forward at ignition, thus facilitating the elongation of the projectile, but having a sufficiently small diameter with respect to the transfer member so as to prevent the induced aerodynamic drag on the piston or stabilizing collar from pulling it from the void during flight, is unique. What retains the transfer member in the void is a novel interaction between the pliant projectile and the transfer member. There is an initial level of sliding friction which is then enhanced by the reduction of the projectile diameter resulting from the elongation of the projectile at ignition, which tends to clamp the projectile tighter about the transfer member.

During flight, after the acceleration phase, when the piston or the stabilization collar is tending to pull the transfer member from the void, a low pressure area is created inside the void by the slight rearward movement of the transfer member with respect to the projectile void, causing the projectile to exert an additional clamping effect on the transfer member. These clamping effects are cumulative and together offer sufficient resistance to the forces tending to withdraw the transfer member from the void, even at the higher muzzle velocities required in the extended range round, which may exceed 700 feet per second.

Upon impact with the target, these clamping effects enumerated above are instantaneously reversed and allow the pliant projectile, having expanded from the force of impact, to readily slide forward on the transfer member and mushroom on the target surface to a multiple of its original diameter.

Smokeless gunpowder at ignition requires a tightly confined volume to provide for rapid and complete combustion. In conventional cartridges this initial volumetric restriction is provided for by the mass and inertia of the projectile. In a less lethal round, the lighter weight of the projectile does not provide sufficient resistance for the powder to ignite properly and combust rapidly.

Accordingly, in the present invention, methods and apparatus are disclosed to provide this initial resistance artificially in either of two ways. First, in a less expensive embodiment, the small amount of powder contained in a standard handgun cartridge, such as a .32 caliber with a primer installed, is sufficient. By severely crimping a diaphragm over the powder, it is momentarily contained at ignition. This handgun cartridge is inserted where the primer is normally placed in a shotgun shell.

The second, albeit more expensive, alternative is to provide a cylindrical metal jacket with perforations in the side wall for a small caliber shell. A small caliber handgun shell, for example a .25 caliber, is press fit into the jacket and the entire assembly inserted the base of the shotgun shell casing. When fired, the powder combusts in the enclosed space, and, as the pressure rises, the combustion rate increases. When the pressure builds up sufficiently, the small caliber shell wall bursts in the vicinity of the perforations in the wall of the jacket and the expanding gases fill the shotgun shell area.

The breaching projectile, while also pliant, differs from the less lethal projectile in that elastomeric matrix, which may be a polymer, is heavily saturated with a greater weight of larger, high density particles such as copper, brass, iron or lead, for example. These particles are loosely held by the elastomer matrix so as to maintain just enough stability and rigidity to exit the weapon and maintain stability during flight.

Upon striking any solid object the heavy pliant projectile delivers its considerable kinetic energy momentum over a larger target surface, efficiently removing door bolts, locks and hinges from their supporting structure. The loosely held metal particles are readily separated from their elastomeric matrix and any kinetic energy the tiny particles may have remaining is quickly dissipated.

Because of the heavy weight of the projectile, a conventional powder and primer is used in the breaching round. In the breaching round the transfer member also remains with the projectile during flight to provide rigidity and stability and, upon impact, provides an axis around which the heavy but pliant projectile can, during entry, symmetrically expand to over twice its original diameter.

The combined action and interaction of these components results, for the first time, in the successful discharge from firearms, particularly shot guns and handguns, of highly pliant, less lethal and breaching projectiles. Similar principles may be applied to the discharge of highly pliant projectiles from rifles, mortar and grenade launchers and other ordnance launching devices currently in law enforcement and military inventories.

Accordingly, beside the objects, advantages and disadvantages of the less lethal and breaching rounds described above, several objects and advantages of the present invention are:

a. To provide a less lethal round which can deliver a highly pliant projectile having a Durometer Shore "A" value ranging from 20 to 40 onto a target body surface with adequate force to cause significant blunt force trauma. However, due to the significant radial displacement of such a pliant projectile upon impact, such force is distributed over a sufficiently large surface area so as to preclude significant, if any, target body penetration by the pliant projectile.

b. Provide a less lethal projectile with a novel self-compensating feature that may be discharged at virtually point blank range without exceeding acceptable kinetic energy density levels on the surface of the target body. At very close range, the higher muzzle velocity causes the projectile to impact with a greater force, causing the highly pliant projectile to expand slightly more at impact than it would at a longer range, thereby automatically compensating for the kinetic energy density levels delivered to the target body surface.

c. Provide a very accurate pliant less lethal cartridge that may be directed at a very specific small area on a target body with a high degree of assurance that the projectile will strike that area. It is an object of this invention that a pliant projectile discharged from a 12-gauge shotgun will repeatedly strike within a two and a half-inch circle at up to forty feet range.

d. Provide an extended range, less lethal cartridge for shotguns which can accurately engage suspects fleeing the scene of a crime or control or dissuade rioters at distances of up to 150 feet.

e. Provide a less lethal round which, by varying the density and size of the projectile, can meet a wide range of custom kinetic energy requirements, ranging from thirty to in excess of three hundred foot pounds.

f. Provide a multiplicity of less lethal cartridges for use by law enforcement and the military which, by varying the Durometer values of the projectile from 10–80 on the Shore "A" scale, will perform in a variety of tactical situations calling for from point blank range to several hundred feet with muzzle velocities varying from 300 feet per second to over 1,500 feet per-second.

g. Provide a frangible round that can deliver a semi-pliant, dense metal filled frangible projectile to a highly resistant mechanism such as a door lock, bolt or hinge with sufficient force as to disable or remove the mechanism from its supporting structure. However, in the process of directing its considerable kinetic energy onto a concentrated area of the mechanism, the pliant matrix completely disintegrates, releasing the minute metal particles that readily lose their remaining kinetic energy, thus reducing or completely eliminating collateral damage to adjacent walls and structures or personnel.

h. To provide a frangible round described in g., above, that can readily penetrate but not exit from automobile engine or radiator compartments and steel belted vehicle tires. During a vehicle pursuit, if a projectile should be fired and completely miss the intended target, in striking the roadway or other surface, even at a low angle of incidence, the projectile will completely disintegrate, releasing its small metal particles that will cause little, if any, damage or injury to other vehicles, their occupants, pedestrians or residents along the roadway. Thus, for the first time, law enforcement officers will have a tool with which to quickly terminate the extended dangerous vehicle pursuits which are becoming increasingly more commonplace.

i. Provide a means to launch highly pliant less lethal projectiles from a variety of ordnance launching tubes such as 40 and 37 mm. grenade launchers for delivery of various flash, stun, acoustical or malodorant devices now in development.

These objects and advantages and others will become apparent from a consideration of the ensuing description and drawings, and are made possible for the first time by the disclosed techniques to safely, reliably and accurately discharge pliant projectiles from firearms and other launching devices described in the present invention.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

DESCRIPTION OF THE PREFERRED EMBODIMENTS

Figure 1:
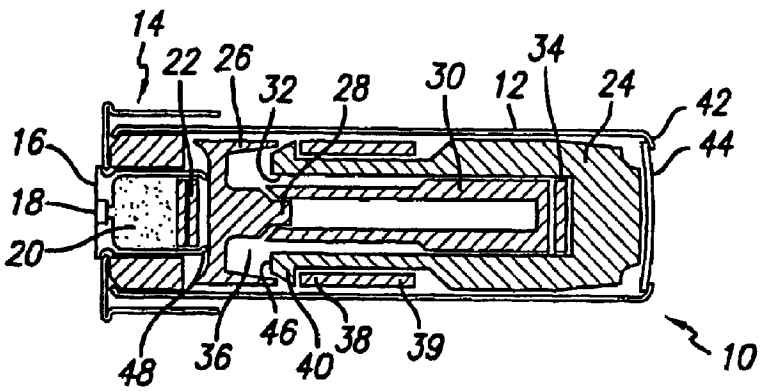
FIG. 1 is a sectional view of a less lethal shotgun cartridge according to the present invention.
Figure 2:
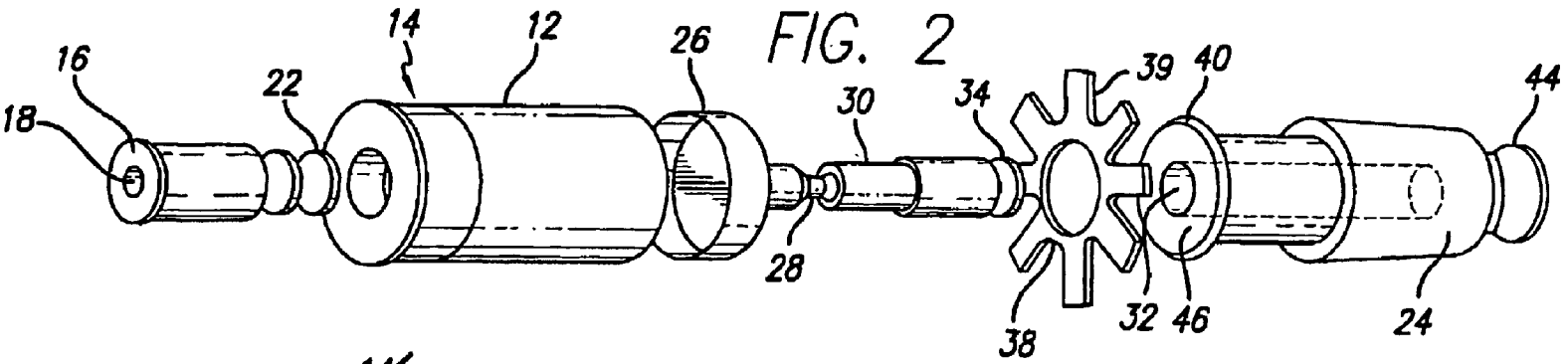
FIG. 2 is an exploded view of the less lethal shotgun cartridge showing interior components of the cartridge of FIG. 1.

Turning first to FIGS. 1 and 2, there is shown, in side sectional view, a less lethal pliant cartridge 10 which includes a main casing 12, a base 14, a small caliber (for example a .32 caliber) shell casing 16 which includes a primer 18 and a powder charge 20 held in by a containment diaphragm 22. Using a small caliber cartridge furnishes an easy way to contain the reduced amount of the powder charge required to maintain combustion efficiency of the charge when fired. It has been found that a small bore cartridge casing can be loaded with the desired amount of powder in a tightly confined space to enhance the reliability of ignition.

Within the main casing 12 are the elements necessary to launch a less lethal pliant projectile 24. A piston 26 has a central post 28 that is adapted to fit into a force transfer member 30. The pliant projectile 24 has an interior cylindrical void 32 into which the transfer member 30 is inserted. A cushion pad 34 is fitted between the transfer member 30 and the interior end of the void 32 to prevent damage to the interior of the projectile 24 due to forces being exerted by the transfer member 30 after ignition of the powder charge and upon impact with the target.

The transfer member 30 and cushion pad 34 are in intimate contact with the interior end of the void 32 of the projectile 24 prior to and after firing. A space 36 is provided between the back 46 of the projectile 24 and the piston 26 to allow for sufficient elongation of the projectile 24 prior to its making contact with the piston 26.

A flexible, flight stabilizing collar 38 with a plurality of fins or tabs 39 is adapted to fold into a cylinder and fits about the base of the projectile 24 in a recessed area that is defined by a flange portion 40 at the base. A crimp 42 in the main casing 12 secures a protective disk 44 in place, keeping the internal components together.

The cartridge 10 fits within a standard shotgun (not shown) and is adapted to be fired when a firing pin strikes the primer 18 of the small caliber shell casing 16 that is secured in the base 14 of the cartridge 10. The powder 20 is contained by the diaphragm 22 which is restrained by a crimp 48 in the end of the shell casing 16.

The powder charge 20 is then ignited and the combustion produces propellant gases under pressure. The diaphragm 22 is blown out and the expanding gases fill the interior of the base 14. Pressure is exerted on the piston 26 which is then forced to move forward. This motion is imparted to the transfer member 30 which is driven into the cushion pad 34.

The mass and inertia of the pliant projectile 24 allows the transfer member 30 to push on the forward end of the projectile 24 which, because of its pliancy and elasticity, tends to elongate the projectile 24, reducing its diameter to a dimension that allows it to fit loosely in the shotgun barrel. The gases continue to expand, exerting additional forces upon the piston 26. The reduction in projectile diameter permits the projectile 24 to start moving forward in the shotgun shell casing as the expanding gases increase the forces on the piston 26.

Eventually, the piston 26 contacts the rear surface 46 of the projectile 24 and overcomes the remaining inertia in the rear portion of the projectile 24. At this time, the transfer member 30, piston 26 and projectile 24 (which is now in its final elongated condition) are all accelerating at the same rate and proceed from the main casing 12 and subsequently the barrel of the weapon.

As the piston 26, transfer member 30 and projectile 24 exit the muzzle of the shotgun, the piston 26 tends to separate from the transfer member 30 which remains with the projectile 24. At the same time, the fins 39 of the stabilizing collar 38 deploy and the projectile 24 tends to regain its original shape. The stabilized projectile 24 now proceeds to its target where, on impact, it expands significantly, transferring its kinetic energy to the target. However, because of its extreme pliability and large "foot print", it will not penetrate either a hard or soft target During flight, the transfer member 30 remains in place in the projectile void 32 and performs several additional functions. It serves a stabilizing function during flight allowing the flight stabilizing collar 38 to do its work. Upon impact with the target body, the projectile 24 strikes nose first. The thick nose section is distended radially outward, exacerbated from behind by the forward inertia of the transfer member 30. The body of the projectile 24, instead of collapsing upon itself, as it might in the absence of the rigid transfer member 30, rather slides forward on the transfer member 30 in a controlled mushrooming effect being urged radially outward by the expanding thick nose section into a beneficial flattened spheroidal or toroidal shape with a resulting diameter of over twice that of the original projectile.

Figure 4:
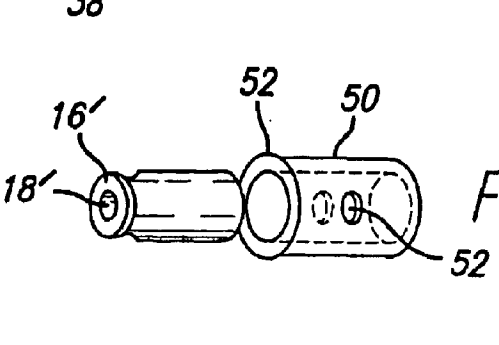
FIG. 4 is an exploded view of a portion of the powder chamber of FIG. 3.
Figure 3:
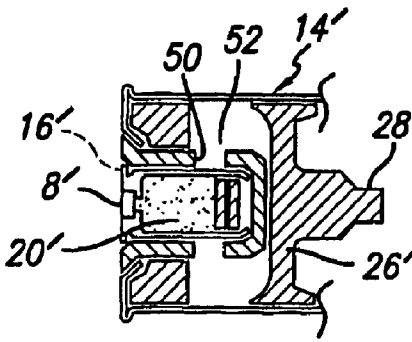
FIG. 3 is a sectional view of an alternative powder chamber.

In FIGS. 3 and 4, there is shown an alternative firing assembly for the cartridges of the present invention. In FIGS. 3 and 4, parts that have counterparts in FIGS. 1 and 2 are given the same reference numerals but with a prime to distinguish them. Rather than permitting uncontrolled expansion of the gases from the combustion of the gunpowder charge 20', a metal jacket so is fitted with a pair of diametrically opposed apertures 52 that are positioned near the front of the shell casing 16'. The piston 26' then abuts the forward end of the metal jacket 50.

With the embodiment of FIGS. 3 and 4, striking the primer 18' ignites the powder charge 20'. The expanding gases are restrained by the metal jacket 50 until the build up of pressure is so great that the shell casing 16' walls rupture in the vicinity of the apertures 52. The expanding gases then engage the piston 26' and the operation proceeds as in the above example. It is believed that by confining the detonation to the interior of the shell casing 16' for a longer period, a more complete combustion is assured.

Figure 5:
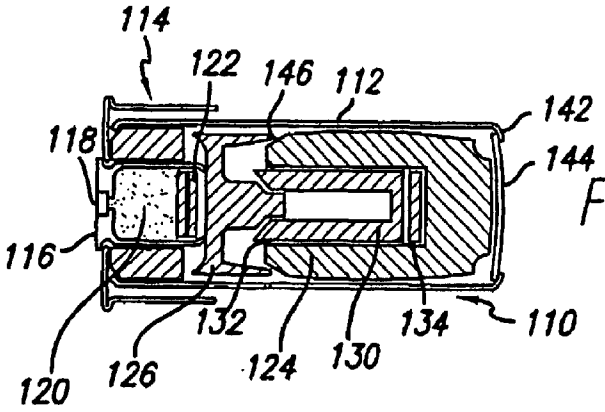
FIG. 5 is a sectional view of an alternative less lethal extended range shotgun cartridge according to the present invention.
Figure 6:
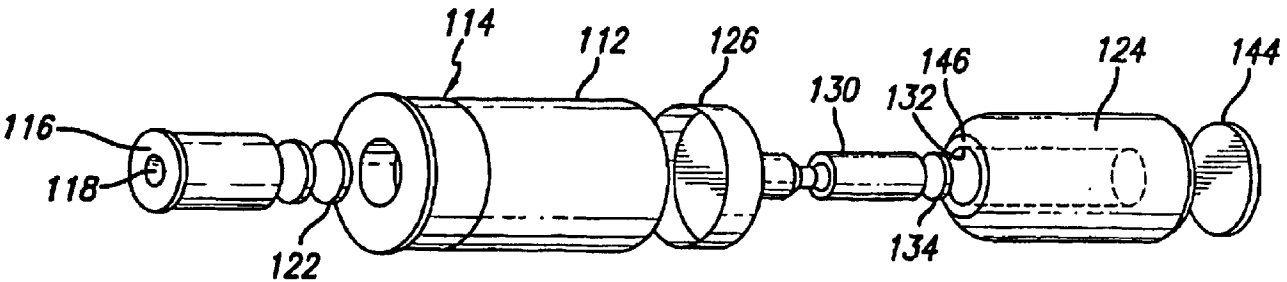
FIG. 6 is an exploded view of the less lethal extended range shotgun cartridge of FIG. 5.

FIGS. 5 and 6 illustrate an alternative embodiment intended for long range applications and to enable more rounds to be stored in a magazine. The extended range cartridge 110 is virtually identical to is regular counterpart, the cartridge 10. The only elements that are lacking are the stabilizing collar 38 and the flange 40 upon which it rests. All other elements are present, although in slightly different dimensions. In the extended range cartridge 110, the piston 126 is press fit into the transfer member 130 and stays with the projectile 124 and transfer member 130 during flight to act as a stabilizing device.

Figure 7:
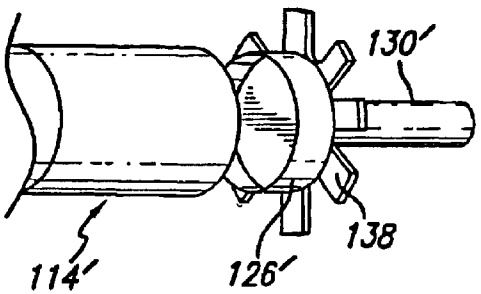
FIG. 7 is an exploded view of yet another alternative extended range shotgun cartridge.

FIG. 7 illustrates still another alternative embodiment of the extended range round shown in FIGS. 5 and 6. In this embodiment, the piston 126' and the transfer member 130' are shown as a unitary element and a stabilizing collar 138 is added to the combination. In this embodiment, the piston 126' retains the stabilizing collar 138 during flight and the transfer member 130' is retained in the cylindrical void 132' by the cumulative clamping effects exerted by the elongation of the highly pliant projectile 124 onto the transfer member 130' in flight.

Figure 9:
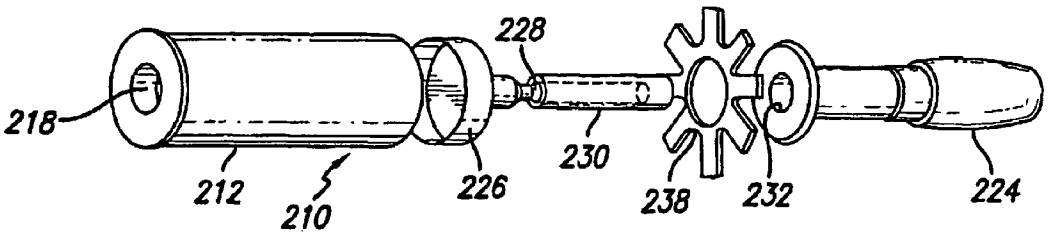
FIG. 9 is an exploded view of the cartridge of FIG. 8.
Figure 8:
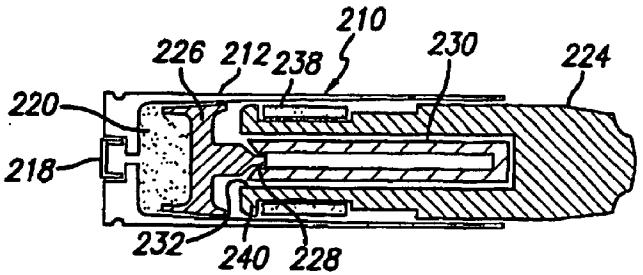
FIG. 8 is a sectional view of a less lethal handgun cartridge according to the present invention.

In FIGS. 8 and 9, the present invention has been modified for use in a handgun. A handgun cartridge 210 has a metal main casing 212 in the base of which is a primer 218 and a powder charge 220. A pliant projectile 224 is fitted into the main casing 212. Unlike the other embodiments, a piston 226 is placed directly over the powder charge 220. The piston 226 includes a post 228 which fits into a transfer member 230 that is placed within a cavity 232 in the projectile 224. The cartridge 210 is fitted with a stabilizing collar 238 which rests on a flange 240 at the base of the projectile 224.

In operation, the handgun cartridge 210 functions in much the same fashion as the shotgun cartridge 10. When the primer 218 ignites the powder charge 220, the expanding gases drive the piston 226 forward. The post 228 engages the transfer member 230 and a forward thrust is exerted against the leading edge of the cylindrical cavity 232. The inertia and mass of the projectile 224 tend to hold the body of the projectile in place as the transfer member 230 moves forward, elongating the projectile 224.

As the projectile 224 elongates, the diameter is reduced which both releases the projectile 224 from the cartridge casing 212 and enables it to travel through the handgun barrel without hindrance. As soon as the muzzle is cleared, the stabilizing collar 238 is deployed and the piston 226 separates. The projectile 224 then proceeds to its target.

For situations in which it is desirable to have a round that can destroy locks or hinges and yet inflict no collateral damage to the surrounding structures or persons in the vicinity, a variation of the projectile of the instant invention is provided. The delivery system, however, is substantially similar to the cartridge 10 of FIGS. 1 and 2 above, but without the stabilizing collar 38.

Figure 10:
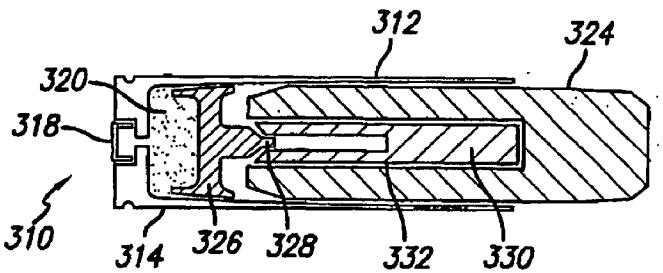
FIG. 10 is a sectional view of a frangible handgun cartridge according to the present invention.
Figure 11:
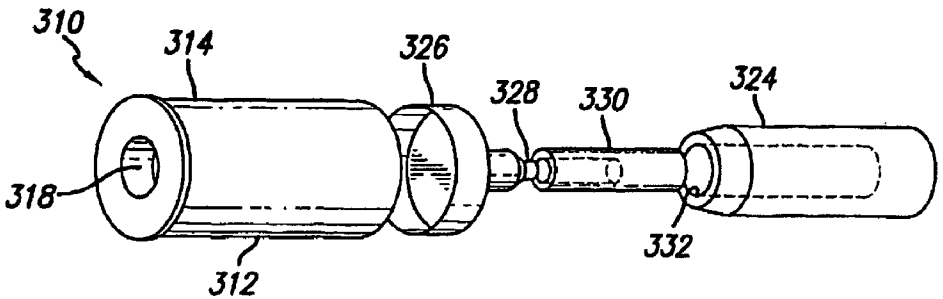
FIG. 11 is an exploded view of the cartridge of FIG. 10.

A breaching cartridge 310 suitable for a hand gun, is shown in FIGS. 10 and 11. A breaching cartridge 310 for a handgun includes a main casing 312, a base 314 and a primer 318. A powder charge 320 is placed in the interior of the cartridge 310. A projectile 324 is fitted into the main casing 312 above a piston 326 which includes a post 328. A transfer member 330 engages the post 328 and is fitted into a cylindrical void 332 of the projectile 324.

The breaching projectile 324 is comprised of an elastomeric compound but is heavily impregnated with particles of a dense, heavy material such as copper, iron, brass, bronze, lead, bismuth or tungsten. Yet other dense or heavy metals may be used if cost is not a consideration. The result is a rather massive projectile which still possesses elastic properties.

In operation, when the transfer member 330 is propelled forward, initially its forward end engages the end of the cylindrical void 332 and begins to stretch the projectile 324. As the piston 326 and the transfer member 330 move forward, the stretch of the projectile 324 is sufficient to reduce the overall projectile diameter to a dimension where it easily traverses the barrel or launching tube of the weapon and exits the muzzle.

Figure 12:
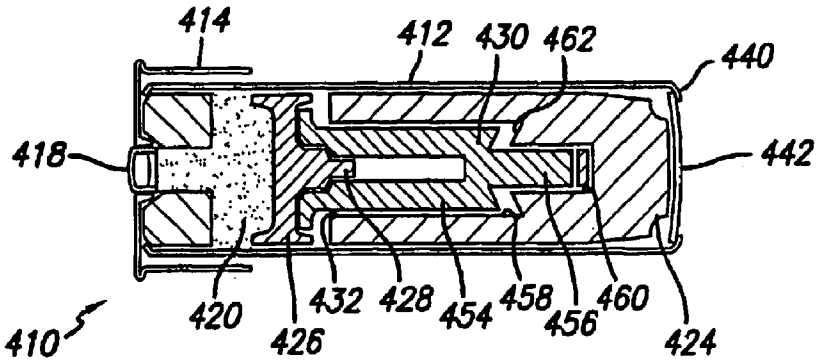
FIG. 12 is a sectional view of a frangible shotgun cartridge according to the present invention.
Figure 13:
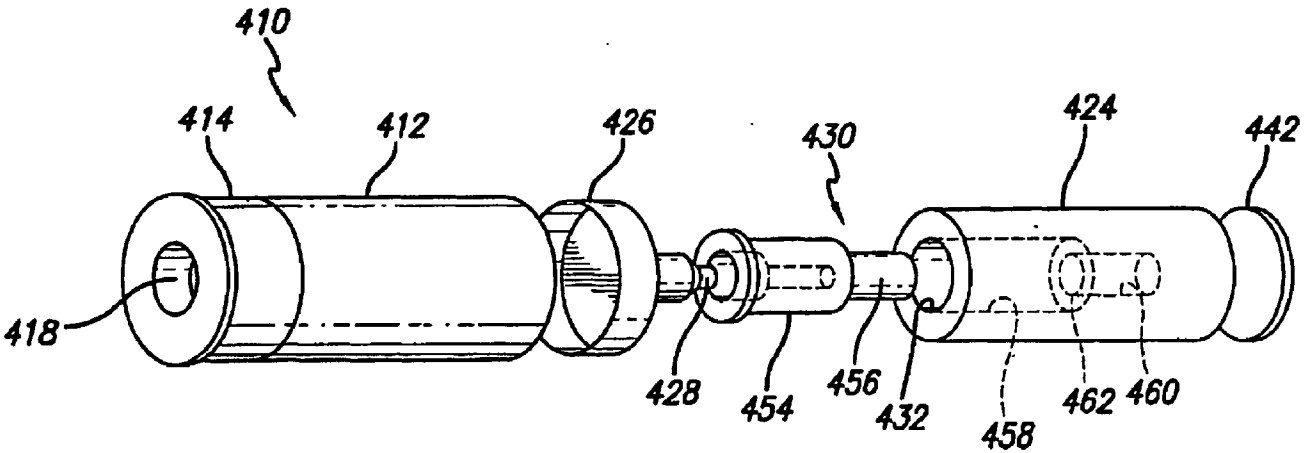
FIG. 13 is an exploded view of the cartridge of FIG. 12.

In FIGS. 12 and 13, components that have their counterpart in FIGS. 10 and 11 bear similar reference numerals but in the 400 rather than 300 range. Accordingly, although the scale is changed to reflect the size difference between shotguns and hand guns, the shotgun breaching cartridge 410 is essentially similar to the handgun breaching cartridge 310, the major difference being that the breaching projectile 424 is in a shotgun shell casing while the handgun breaching projectile 324 is in a hand gun shell casing and the transfer member 430 does not have the same diameter throughout its length.

A breaching cartridge 410 for a shotgun includes a main casing 412, a base 414 and a primer 418. A powder charge 420 is placed in the interior of the cartridge 410. A projectile 424 is fitted into the main casing 412 above a piston 426 which includes a post 428. A transfer member 430 engages the post 428 and is fitted into a cylindrical void 432 of the projectile 424.

The breaching projectile 424 is also comprised of an elastomeric compound heavily impregnated with particles of a heavy metal such as copper, iron, brass, lead, bismuth, or tungsten. As before, other dense, heavy materials may be used, consistent with cost considerations. The result is a rather massive projectile which still possesses elastic properties. However, because of the higher inertia, and the frangibility of the projectile 424 and to locate the center of gravity as far forward in the projectile 424 as possible, the transfer member 430 is modified to a two stage configuration with a first, larger diameter portion 454 and a second, smaller diameter portion 456. The cylindrical void 432 is similarly modified to have a large diameter portion 458, a smaller diameter portion 460 and an interior shoulder 462 at the transition point.

In operation, when the transfer member 430 is propelled forward, initially its forward end engages the end of the cylindrical void 432 and begins to stretch the projectile 424. To prevent shearing of the projectile 424 under such forces, after a predetermined amount of stretch has taken place, the larger diameter portion 454 of the transfer member 430 engages the interior shoulder 462 and applies force over a greater area, relieving the stress on the smaller diameter portion 460 of the cylindrical void 432. As the piston 426 and the transfer member 430 move forward, the stretch of the projectile 424 is sufficient to reduce the overall projectile diameter to a dimension where it easily traverses the barrel or launching tube of the weapon and exits the muzzle.

Figure 14:
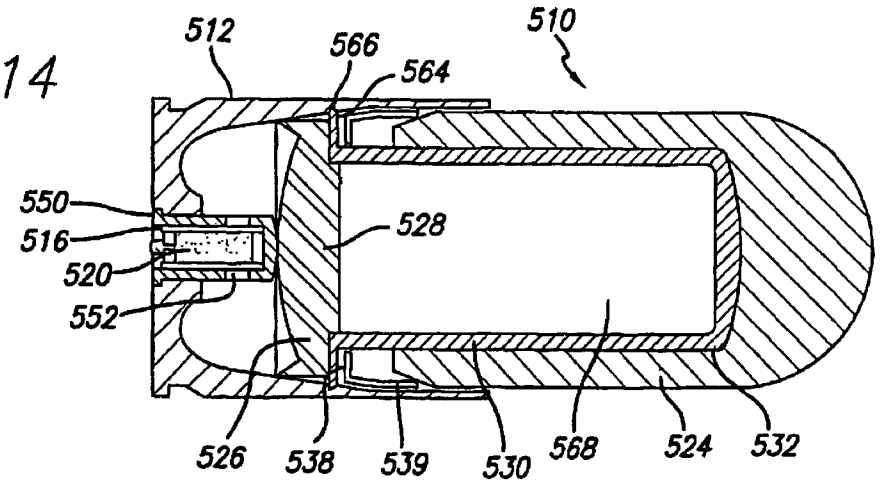
FIG. 14 is a sectional view of a less lethal 40 mm type cartridge according to the present invention.
Figure 15:
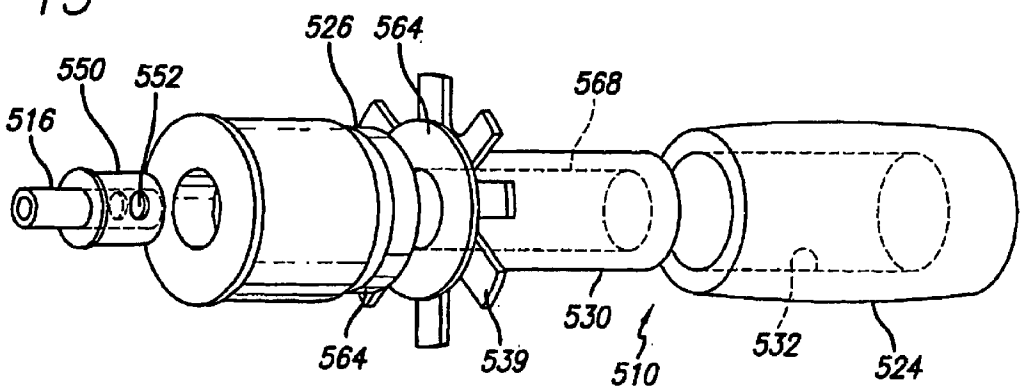
FIG. 15 is an exploded view of the cartridge of FIG. 14.

FIGS. 14 and 15 illustrate another alternative embodiment intended to provide less lethal projectiles suitable for deployment from, for example, a 40 mm grenade launcher tube. As shown in FIG. 14, a 40 mm cartridge casing 512 has been modified and adapted to accept a less lethal projectile 524. The projectile 524 is substantially similar to its smaller counterparts. A firing assembly 550, similar to that shown in FIGS. 3 and 4 is employed for a higher degree of ballistic consistency which is required in these weapons. A low caliber cartridge 516 is inserted into the firing assembly 550.

The transfer member 530 has been modified to include a flange 564 which is captured by a locking groove 566 in the interior surface of the casing 512. The piston 526 has been modified, converting the extending post which engages the transfer member, into a slight projection 528 which engages the interior of the transfer member 530. The flange 564 rests on the face of the piston 526 so that piston 526 has secure and intimate contact with the transfer member 530 upon firing.

On ignition of the powder charge 520, the expanding gases exert a force upon the piston 526 and with it, the transfer member 530. When the force is sufficient to break the transfer member flange 564 from the locking groove 566, the piston 526 and transfer member 530 move forward and the forward end of the transfer member 530 engages the cylindrical void 532 within the projectile 524. The transfer member 530 effectively elongates the projectile 524 by exerting a force to the front end of the projectile 524. In this embodiment, the transfer member 530 is provided with an interior void 568 into which some other payload could be located.

A stabilizing collar 538 with a plurality of fins or tabs 539 is mounted at the rear of the projectile 524 and is retained by the flange 564 of the transfer member 530. When the force exerted by the transfer member 530 upon the projectile 524 is sufficient to reduce the diameter of the projectile 524 so that it may safely transit the firing tube and not be hindered by rifling that may be within the barrel or firing tube, the projectile 524 will travel through the tube and, upon exiting, the tabs 539 extend and provide stabilization of the flight path comparable to that afforded by rifling in the interior of a gun barrel. As in the embodiments above, the transfer member 530 is frictionally retained within the projectile 524 notwithstanding the drag upon the stabilizing tabs 539.

Thus there has been shown, in alternative embodiments, a new type of ammunition which, when utilizing a highly pliant, extremely soft projectile that may be impregnated with a fine, dense metal powder results in a less lethal round and, when utilizing a highly pliant, soft projectile that has been highly saturated with small but heavy metallic particles, can strike with devastating force and effectively disintegrate before causing any collateral damage to structures or bystanders.

What is claimed as new is:

1. A pliant projectile for use with a cartridge including a powder charge which, when ignited, generates expanding gases comprising:

a projectile body of a soft elastomeric material, said projectile body having a front end, a rear end and a central void, said central void extending from the rear end into the projectile interior;

a piston member, having a face surface and a force transfer element, mounted adjacent the powder charge; and a motion transfer member including a projecting element adapted at one end to be engaged with said force transfer element and, at the other, to be received in said central void interior, said piston member being adapted to be displaced by the expanding propellant gases of the powder charge when ignited;

whereby the projectile, when used in a weapon, functions so that upon ignition of the powder charge, under the influence of expanding gases resulting from the powder charge ignition within the weapon, initially deploy said piston, said piston engaging said motion transfer member to bring said transfer member into contact with the interior of said projectile body causing said projectile body to stretch and thereby reduce its diameter to enable easy passage through the weapon, the expanding gases further deploying both said projectile body and said motion transfer member until said piston contacts said projectile body rear end, after which expanding gases further deploy said projectile body and said transfer member until said projectile body clears the weapon.

2. The pliant projectile of claim 1 wherein said projectile body has a Shore "A" Durometer value between 20 and 40.

3. The pliant projectile of claim 1 wherein said projectile body has a Shore "A" Durometer value greater than 10.

4. The pliant projectile of claim 1 wherein said projectile body has a Shore "A" Durometer value less than 80.

5. The pliant projectile of claim 1, wherein said projectile body has dense particles incorporated therein to increase the mass thereof.

6. The pliant projectile body of claim 5 wherein said projectile body is saturated with metallic particles selected from the group including copper, brass, bronze, iron, bismuth, lead and tungsten to increase the mass of said projectile body.

7. The pliant projectile combination of claim 1 further including a stabilizer member surrounding said projectile body near the rear end thereof, said stabilizer being normally stored in a retracted configuration but being adapted to be extended once said projectile body clears the weapon.

8. The pliant projectile combination of claim 7 wherein said stabilizer member includes a ring portion surrounding said projectile body and a plurality of tab elements radially extending from said ring portion when otherwise unrestrained but arranged to be substantially parallel to said projectile body when stored within the cartridge.

9. The pliant projectile cartridge of claim 1 wherein said propellant charge is contained within a small caliber shell including a primer.

10. The pliant projectile cartridge of claim 1 wherein said cartridge body includes an apertured jacket adapted to receive a small caliber cartridge including a primer, said propellant charge being contained within said small caliber cartridge shell, whereby upon ignition of said propellant charge, said cartridge shell ruptures at the jacket apertures, allowing expanding gases to enter the cartridge body for propelling said motion transfer member and said projectile body.

11. For use in a weapon having a firing chamber and a barrel, a pliant projectile cartridge including, in combination:

a cartridge body containing a propellant charge adapted to be received in the firing chamber;

motion transfer means including, at one end, a piston face and, at the other end, an elongation;

a substantially cylindrical pliant projectile body including a front end, a rear end and a central void, said control void including a forward end and a rearward end, said central void located at the rear end of said projectile and adapted to receive said transfer means elongation; and means for igniting the propellant charge to create expanding gases;

whereby expanding gases impinge upon said piston face imparting forward motion thereto, said motion transfer member elongation contacting the forward end of the void in said projectile body pushing said projectile body forward thereby reducing said projectile body diameter to easily clear the weapon barrel, said piston eventually contacting the rear surface of said projectile body to impart forward motion thereto sufficient to accelerate the projectile through the weapon barrel until it exits therefrom.

12. The pliant projectile cartridge of claim 11, wherein said motion transfer means comprises a unitary member combining said piston face and said elongation.

13. The pliant projectile cartridge of claim 11 wherein said projectile body is comprised of a soft elastomeric material having a Shore "A" Durometer value between 10 and 80.

14. The pliant projectile cartridge of claim 11 wherein said projectile body is comprised of a soft elastomeric material having a Shore "A" Durometer value between 20 and 40.

15. The pliant projectile body of claim 13 wherein said projectile body is saturated with fine metallic particles selected from the group including copper, brass, bronze, iron, bismuth, lead and tungsten to increase the mass of said projectile body.

16. The pliant projectile cartridge of claim 11 wherein motion transfer means include, on a side of said piston face opposite said elongation a peripheral flange that, in free flight, stabilizes the flight of said projectile body.

17. The pliant projectile combination of claim 11 further including a stabilizer member surrounding said projectile body near the rear end thereof, said stabilizer being normally stored in a retracted configuration but being adapted to be extended once said projectile body clears the weapon.

18. The pliant projectile cartridge of claim 11 wherein said propellant charge is contained within a small caliber shell including a primer.

19. The pliant projectile cartridge of claim 11 wherein said cartridge body includes an apertured jacket adapted to receive a small caliber cartridge including a primer, said propellant charge being contained within said small caliber cartridge shell, whereby upon ignition of said propellant charge, said cartridge shell ruptures at the jacket apertures, allowing expanding gases to enter the cartridge body for propelling said motion transfer member and said projectile body.

20. A pliant projectile for use with a cartridge including a powder charge which produces expanding propellant gses when ignited comprising:

a projectile body of elastomeric material having metallic granules incorporated therein, said projectile body having a front end, a rear end and a central void, said central void extending from the rear end into the projectile interior;

a piston member, having a face surface and force transfer element, mounted adjacent the powder charge; and a motion transfer member including a projecting element adapted at one end to be engaged with said force transfer element and, at the other, to be received in said central void, said piston member being adapted to be displaced by the expanding propellant gases of the powder charge when ignited;

whereby the projectile, when used in a weapon, functions so that, upon ignition of the powder charge, under the influence of expanding gases within the weapon, initially deploy said piston, said piston engaging said motion transfer member to bring said motion transfer member into contact with the interior of said projectile body causing said projectile body to stretch and thereby reduce its said projectile body diameter to enable easy passage through the weapon, the expanding gases further deploying both said projectile body and said motion transfer member until said piston contacts said projectile body rear end, after which expanding gases further deploy said projectile body and said transfer member until said projectile body clears the weapon.

21. The pliant projectile of claim 20 wherein said soft elastomeric material has a Shore "BA" Durometer value between 10 and 80.

22. The pliant projectile of claim 20 wherein said soft elastomeric material has a Shore "A" Durometer value between 20 and 40.

23. The pliant projectile of claim 20 wherein said metallic granules are selected from the group including iron, copper, brass, bronze, bismuth, lead and tungsten.

24. The pliant projectile of claim 20, above, wherein said projectile internal void includes a first diameter portion adjacent the rear end of the projectile, a second, smaller diameter portion near the front of the projectile and a shoulder between the first and second portions, and whereby said force transfer member has a similar first diameter portion, a second, smaller diameter portion and a shoulder between the portions, said second transfer member portion engaging said second void portion to elongate said projectile and, after a predetermined elongation, said transfer member shoulder engaging said void shoulder to impart additional forces to said projectile at an area closer to the rear of said projectile.

25. For use in a weapon having a firing chamber and a barrel, a pliant projectile cartridge including, in combination:

a cartridge body containing a propellant charge adapted to be received in the firing chamber;

motion transfer means comprising, at one end, a piston face and, at the other end, an elongated element;

a substantially cylindrical pliant projectile body including a front end, a rear end and a a central void, said central void including a forward end and a rearward end, said central void located at the rear end of said projectile and adapted to receive said elongated element; and means for igniting the propellant charge to create expanding gases;

whereby expanding gases impinge upon said piston face imparting forward motion thereto, said motion transfer member elongated element contacting the forward end of the void in said projectile body pushing the projectile body forward thereby reducing said projectile body diameter to easily clear the weapon barrel, said piston face eventually contacting the rear surface of said projectile body to impart forward motion thereto sufficient to accelerate the projectile through the weapon barrel until it exits therefrom.

26. The pliant projectile cartridge of claim 25, wherein said motion transfer means piston face and elongated element are combined in a unitary structure.

27. The pliant projectile cartridge of claim 25, above, wherein said projectile body internal void includes a first diameter portion adjacent the rear end of the projectile body, a second, smaller diameter portion near the front of the projectile body and a shoulder between the first and second portions, and whereby said force transfer means elongated element has a similar first diameter portion, a seconds smaller diameter portion and a shoulder between the portions, said second transfer means elongated element engaging said second void portion to elongate said projectile body and, after a predetermined elongation, said transfer means elongated element shoulder engaging said void shoulder to impart additional forces to said projectile at an area closer to the rear of said projectile.

28. The pliant projectile cartridge of claim 25 further including a stabilizer member surrounding said projectile body near the rear end thereof, said stabilizer being normally stored in a retracted configuration but being adapted to be extended once said projectile body clears the weapon.

29. The pliant projectile cartridge of claim 28, wherein said stabilizer member includes a plurality of individual tabs radially extending from said stabilizer member.

30. The pliant projectile cartridge of claim 24 wherein said propellant charge is contained within a small caliber shell including a primer.

31. The pliant projectile cartridge of claim 25 wherein said cartridge body includes an apertured jacket adapted to receive a small caliber cartridge including a primer, said propellant charge being contained within said small caliber cartridge shell, whereby upon ignition of said propellant charge, said cartridge shell ruptures at the jacket apertures, allowing expanding gases to enter the cartridge body for propelling said motion transfer member and said projectile body.

* * * * *